US008348265B2

(12) United States Patent
Isogai

(10) Patent No.: US 8,348,265 B2
(45) Date of Patent: Jan. 8, 2013

(54) IMAGE FORMING APPARATUS

(75) Inventor: Yoji Isogai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 458 days.

(21) Appl. No.: 12/776,823

(22) Filed: May 10, 2010

(65) Prior Publication Data

US 2010/0295241 A1 Nov. 25, 2010

(30) Foreign Application Priority Data

May 21, 2009 (JP) ..... 2009-123080

(51) Int. Cl.
*B65H 9/04* (2006.01)
*B65H 7/02* (2006.01)

(52) U.S. Cl. ..... 271/242; 271/227

(58) Field of Classification Search ..... 271/227, 271/242, 229, 245–246, 265.01
See application file for complete search history.

(56) References Cited

U.S. PATENT DOCUMENTS 5,022,642 A * 6/1991 Hasegawa et al. ..... 271/10.12
5,775,690 A * 7/1998 Quesnel et al. ..... 271/242
7,347,419 B2 * 3/2008 Sano et al. ..... 271/265.04
7,604,233 B2 * 10/2009 Nakazawa et al. ..... 271/242
8,047,538 B2 * 11/2011 Katsura et al. ..... 271/242
8,091,888 B2 * 1/2012 Tamamoto ..... 271/264
2010/0052248 A1 * 3/2010 Fushimi ..... 271/227

FOREIGN PATENT DOCUMENTS

JP 2006-312545 11/2006

* cited by examiner

*Primary Examiner* — Patrick Cicchino
(74) *Attorney, Agent, or Firm* — Frommer Lawrence & Haug LLP

(57) ABSTRACT

An image forming unit may include a capability of determining whether paper conveyed through the unit is bending. In some embodiments, an amount of bending of the conveyed paper may be determined. An embodiment of an image forming apparatus may include a paper feeding unit, an image forming unit, a skew correcting roller pair, a rotary member pair, sensors, signal processing units, and a control unit. A rotary member pair may convey a sheet to the skew correcting roller pair. Sensors may be disposed at various positions along the conveying path. In some embodiments, the sensors may include transmitting units and/or receiving units. These units may be positioned such that a conveyed sheet passes through therebetween. Signal processing units and control units may allow for the determination of the bending of conveyed sheets.

17 Claims, 9 Drawing Sheets

IMAGE FORMING APPARATUS

INCORPORATION BY REFERENCE

This application is based upon and claims the benefit of priority from the corresponding Japanese Patent application No. 2009-123080, filed May 21, 2009, the entire contents of which are incorporated herein by reference.

FIELD OF THE INVENTION

The present invention relates to an image forming apparatus, such as a printer, a multifunctional peripheral, a copier or a facsimile machine, and a method of forming an image.

BACKGROUND OF THE INVENTION

Hitherto, image forming apparatuses have formed an image on a sheet conveyed in the apparatus. When a sheet is conveyed incorrectly, for example, a jam (paper jam) may occur and image formation may be not performed properly.

In some cases, to correct skew of a sheet which is being conveyed, the sheet is pressed against a registration roller pair so that the sheet bends.

When the sheet is bent, the leading edge of the sheet may be caused to fit into the nip of a registration roller pair by the elasticity of the sheet itself, thereby correcting the skew. After correction of the skew, conveying the sheet is restarted. A conventional image forming apparatus for adjusting the bending amount of a sheet in a conveying path will be described below.

In an image forming apparatus including an ultrasonic sensor, having a transmitting unit and a receiving unit being disposed opposite each other having an interval therebetween such that a sheet conveying path through which a sheet is conveyed is disposed therebetween, a first rotary member pair, and a second rotary member pair positioned downstream of the first rotary member pair in a conveying path, an upper edge of the sheet held and conveyed by the first rotary member pair is contacts the second rotary member pair and the sheet is stopped. The apparatus further includes the sheet conveying device for adjusting the stop timing of the first rotary member pair so that a value detected by the ultrasonic sensor does not exceed a predetermined threshold value.

In the above-described image forming apparatus, in some cases, the sheet is bent by a registration roller pair.

However, when the sheet is bent too much, folding of the sheet may occur. Whereas, if amount of bending is small, the skew of the sheet may not be corrected properly.

It is therefore necessary to control the bending amount of the sheet in order to properly convey the sheet.

For example, a fixing unit includes rotary member pair that sandwiches a sheet between the members. The fixing unit conveys the sheet while heating the sheet and applying pressure to the sheet in order to fix a toner image onto the sheet.

If a conveying speed of the fixing unit is slower than a speed at which a sheet is conveyed to the fixing unit, bending of the sheet may occur, thus causing the sheet to be folded in a Z-shaped pattern (hereinafter "Z-shaped folding"). The Z-shaped folding may also causes a jam in the fixing unit or in a position downstream of the fixing unit.

Typically, therefore, a sheet is bent in a position where bending of the sheet hardly causes an adverse effect on the conveyance of the sheet, e.g., a position upstream of the registration roller pair where conveying of the sheet is substantially insusceptible to the bending.

Controlling the bending amount of a sheet in the conveying path, as described above, is required for proper conveying of the sheet. Factors similarly causing a jam of a sheet include feeding of multiple sheets.

Multiple sheets feeding is a phenomenon caused by moisture or static electricity. Two or more sheets are fed from a paper feeding cassette or the like at a time adhering each other. If multiple sheets feeding occurs, the sheets are caught in a conveying path or various rotary members arranged in the conveying path, thus causing a jam.

Proper conveying of a sheet therefore requires detecting not only the amount of bending of a sheet but also the occurrence of multiple sheets feeding.

As for the related-art image forming apparatus, the amount of bending of a sheet can be detected by the ultrasonic sensor and a sensor flag. Unfortunately, such an apparatus needs the sensor flag and does not detect the amount of bending of a sheet accurately because the bending amount is smaller than 10 mm and the sonic wave runs about 340 meter per second. In order for such an apparatus to detect the bending amount of the sheet accurately, the apparatus needs a very accurate time measurement system which can measure time to an accuracy of a nanosecond, and thus, the apparatus becomes too expensive.

SUMMARY OF THE INVENTION

The present invention has been made in consideration of the above-described problems. Accordingly, it is an object of some embodiments of the present invention to achieve proper conveying of a sheet while accomplishing cost reduction for detecting the bending amount of the sheet in a conveying path only using a sensor.

According to an embodiment, an image forming apparatus may include the following elements. A paper feeding unit feeds a sheet to an image forming unit. The image forming unit forms a toner image on the sheet. A skew correcting roller pair may be disposed upstream of the image forming unit in the sheet conveying direction in which the sheet is conveyed. In some embodiments, the conveyed sheet may contact the skew correcting roller pair and is then bent. Contact between the sheet and the roller pair may include, but is not limited to contacting, bringing in contact with, pressing against, or any other term known in the art. Bending of a portion of the sheet may include, but is not limited to deflecting, deviating from planar, curling, arcing, bowing, buckling or any other term known in the art. For example, the conveyed sheet may be pressed against the skew correcting roller pair and/or brought into contact with the skew correcting roller pair. After contacting the skew correcting roller pair the sheet may then bend. The skew correcting roller pair may be rotated after the sheet is bent sufficiently. A rotary member pair conveys the sheet to the skew correcting roller pair. A first sensor may be disposed upstream of the skew correcting roller pair in the sheet conveying direction. The first sensor may include a first transmitting unit transmitting a sending signal (e.g., an ultrasonic wave) and a first receiving unit positioned opposite the first transmitting unit having an interval therebetween. The conveyed sheet may travel through the interval between the first transmitting unit and the first receiving unit. In some embodiments, the first receiving unit may output an output voltage. A first signal processing unit may process the output voltage of the first receiving unit to output a first reception level signal indicating a reception level of the first receiving unit. A control unit may control sheet conveyance in the image forming apparatus, receive the first reception level signal, and evaluate, based on at least the first reception level signal, the bending of the sheet contacting the skew correcting roller pair. For example, a control unit may control conveyance of a sheet based on an evaluation of whether a reception level signal reaches a predetermined reception level.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the invention are pointed out in particularity in the claims annexed to and forming a part of this disclosure. For a better understanding of the invention, its operating advantages and specific objects attained by its uses, reference is made to the accompanying descriptive matter in which embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which:

FIG. 5A illustrates a reception level of the sensor when the angle of inclination is 0 degree, FIG. 5B illustrates a reception level of the sensor when the angle of inclination is 10 degrees, FIG. 5C illustrates a reception level of the sensor when the angle of inclination is 20 degrees, FIG. 5D illustrates a reception level of the sensor when the angle of inclination is 30 degrees, FIG. 5E illustrates a reception level of the sensor when the angle of inclination is 40 degrees;

DETAILED DESCRIPTION OF THE EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

An embodiment will now be described with reference to FIGS. 1 to 7. The configuration of each component and the arrangement of components which will be described in the following embodiments are not intended to restrict the scope of the invention but are illustrative of some implementations within the scope of the invention.

Figure 1:
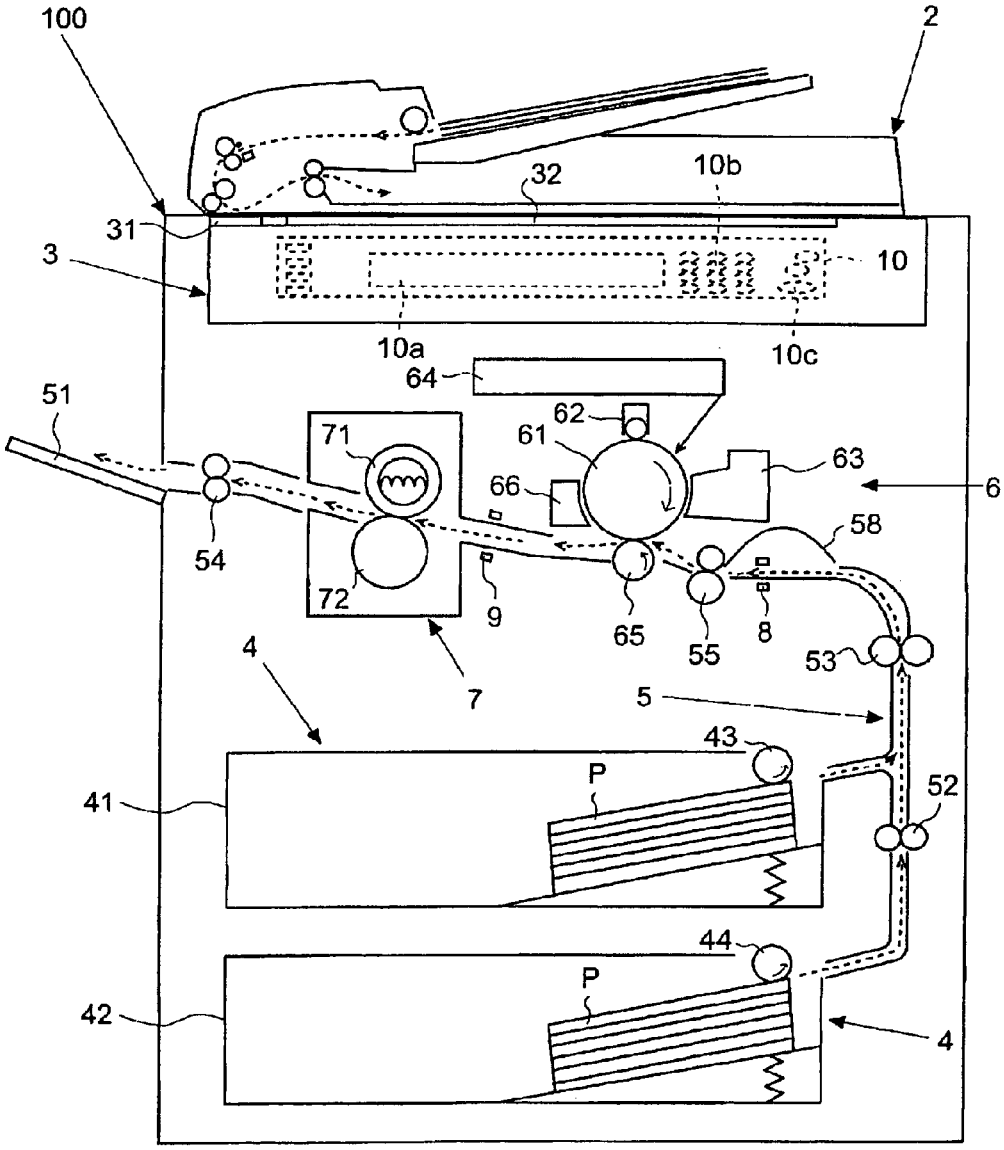
FIG. 1 is a cross-sectional view illustrating the schematic configuration of a multifunctional peripheral according to an embodiment.

A general configuration of an electrophotographic digital multifunctional peripheral 100 (an example of an image forming apparatus) according to an embodiment will first be described with reference to FIG. 1. FIG. 1 is a cross-sectional view of the schematic configuration of multifunctional peripheral 100 according to an embodiment.

Referring to FIG. 1, multifunction peripheral 100 according to an embodiment includes document conveying device 2 in the uppermost part thereof and further includes image reading unit 3, paper feeding unit 4, conveying path 5, image forming unit 6, and fixing unit 7 which are arranged in a main body of multifunctional peripheral 100 under document conveying device 2. In addition, operation panel 10, indicated by a broken line in FIG. 1, for inputting to and setting on multifunctional peripheral 100 is provided for on the front side of multifunctional peripheral 100.

In some embodiments, document conveying device 2 automatically and successively conveys documents having images to be read toward feed scanning contact glass 31 (scanning position) on the upper surface of image reading unit 3. As depicted in FIG. 1 image reading unit 3, may be disposed under document conveying device 2, and includes optical members (not shown) such as an exposure lamp, mirrors, a lens, and an image sensor.

In an embodiment, multiple contact glasses may be utilized. Contact glass on an upper surface of image scanning unit 3 may be broadly divided into two types. As shown in FIG. 1, feed scanning contact glass 31 is disposed on the left and placement scanning contact glass 32 is disposed on the right. The exposure lamp may emit light to a document passing on feed scanning contact glass 31 or a document placed on the placement scanning contact glass 32. The mirrors and the lens guide reflected light from the document to the image sensor. The image sensor converts an optical signal for each pixel into an electrical signal, thus obtaining image data of the document.

In some embodiments, paper feeding unit 4, disposed in the lowermost part of multifunctional peripheral 100, feeds a sheet P, such as copy paper, OHP paper, or label paper, toward registration roller pair 55 (an example of skew correcting roller pair), image forming unit 6, and the like. As depicted in FIG. 1, paper feeding unit 4 includes cassettes 41 and 42 and paper feeding rollers 43 and 44 and the like. In an embodiment, cassettes 41 and 42 are vertically arranged in two levels to accommodate stacked sheets P of different sizes and types. In some embodiments, paper feeding rollers 43 and 44 are in contact with the uppermost sheets P in the cassettes, respectively. When an instruction to form an image is given to multifunctional peripheral 100, paper feeding roller 43 or 44 rotates in a predetermined direction (clockwise in FIG. 1) by a motor (not shown), thus feeding sheets P to conveying path 5 one by one.

In some embodiments, conveying path 5 is a passage for conveying the sheet P fed from paper feeding unit 4 to paper output tray 51. In conveying path 5, for example, a plurality of conveying roller pairs 52, 53, and 54 (each conveying roller pair corresponds to a rotary member pair and are assigned reference numerals sequentially from the upstream side of conveying path 5 in FIG. 1), registration roller pair 55, and guide members (not shown) and the like are arranged for conveying the sheet P in the apparatus. Some embodiments may include image forming unit 6 and fixing unit 7 disposed along conveying path 5.

In some embodiments, conveying roller pairs 52, 53, and 54 are coupled to a driving mechanism including conveying motor 56 (refer to FIG. 2) and gears (not illustrated). Conveying roller pairs 52, 53, and 54 rotate to convey sheets P. A plurality of guide members may be arranged to guide the sheet P in the conveying direction. Conveying roller pair 53 serves as a rotary member pair for conveying the sheet P from paper feeding unit 4 to registration roller pair 55.

An embodiment may include registration roller pair 55 disposed upstream of image forming unit 6 in the sheet conveying direction in which the sheet is conveyed. In some embodiments, conveyed sheet P contacts registration roller pair 55 and is bent by registration roller pair 55. For example, conveyed sheet P may be pressed against registration roller pair 55 such that the conveyed sheet P bends. After that, registration roller pair 55 rotates and conveys the sheet P. Stopping or executing the conveyance (ON/OFF of rotation) of the sheet P is controlled by electromagnetic clutch 57 (refer to FIG. 2) or the like. In some embodiments, registration roller pair 55 feeds the sheet P in timing with a formation of a toner image formed by image forming unit 6. Guide members may include, but are not limited to bending guides. In some embodiments, bending guide 58 for guiding the bending of the sheet P is disposed upstream of registration roller pair 55 and downstream of conveying roller pair 53 in the sheet conveying direction. Some embodiments may include one or more sensors for detecting the inclination of the bent sheet P contacting registration roller pair 55 disposed along bending guide 58. In addition, sensors may detect when multiple sheets are fed. Sensors utilized may include, but are not limited to acoustic sensors such as ultrasonic sensors, optical sensors such as photoelectric sensors, as well as other transducers and/or transceivers, and/or combinations thereof. In some embodiments, sending signals utilized may include, but are not limited to ultrasonic waves, light, and/or any signals known in the art. As shown in FIG. 1, ultrasonic sensor 8 is disposed upstream of registration roller pair 55 and downstream of conveying roller pair 53 in the sheet conveying direction.

In an embodiment, image forming unit 6 forms a toner image on the basis of image data obtained by image reading unit 3 or image data transmitted form user terminal 200 (refer to FIG. 2) and transfers the toner image onto the sheet P, thus forming an image on the sheet P. As shown in FIG. 1, some embodiments may include image forming unit 6 having photosensitive drum 61, and positioned around photosensitive drum 61, charging device 62, developing device 63, exposure device 64, transfer roller 65, and cleaning device 66 and the like. In some embodiments, the devices positioned around the photosensitive drum may vary. For example, some embodiments may include multiple devices of a similar type.

In some embodiments, photosensitive drum 61 is disposed in substantially the center of image forming unit 6 and is supported so as to be rotatable in the direction shown by an arrow in FIG. 1. Charging device 62, disposed above photosensitive drum 61, charges the surface of photosensitive drum 61 at a predetermined potential. Exposure device 64 includes, for example, a laser scanning unit and emits light to the surface of photosensitive drum 61 on the basis of image data for scanning exposure, thus forming an electrostatic latent image on photosensitive drum 61. As shown in FIG. 1, developing device 63 may be disposed to the right of photosensitive drum 61. Developing device 63 may charge toner and supply the toner to the electrostatic latent image on photosensitive drum 61, thus developing the image.

Some embodiments of transfer roller 65 may be disposed under photosensitive drum 61 and is in pressure contact with photosensitive drum 61 to form a nip therebetween. During printing photosensitive drum 61 and transfer roller 65 rotate to convey the sheet P.

In some embodiments, the sheet P conveyed from registration roller pair 55 enters the nip between photosensitive drum 61 and transfer roller 65. When the sheet P passes through the nip, a predetermined voltage is applied to transfer roller 65, so that the toner image formed on photosensitive drum 61 is transferred to the sheet P. Cleaning device 66 may remove toner remaining on the surface of photosensitive drum 61 after completion of the transfer for forming the next toner image.

As depicted in FIG. 1, fixing unit 7, disposed downstream of image forming unit 6 in the sheet conveying direction, fixes the toner image, formed by image forming unit 6 and transferred to the sheet P, while conveying the sheet P. In an embodiment, fixing unit 7 mainly includes heating roller 71 and pressure roller 72. Heating roller 71 may include a heat source. In some embodiments, pressure roller 72 is in pressure contact with heating roller 71 to form a nip therebetween. During fixing, heating roller 71 and pressure roller 72 rotate to convey the sheet P entering the nip therebetween. The sheet P having the transferred toner image is heated and pressurized while passing through the nip so that toner is melted and heated, thus fixing the toner image to the sheet P. The sheet P subjected to fixing is output to paper output tray 51. Thus, image forming processing for one sheet is completed.

In some embodiments, operation panel 10 (an example of an input unit) may all allow a user to provide an instruction and an input for settings to multifunctional peripheral 100. Referring to FIG. 1, operation panel 10 includes touch panel liquid crystal display 10*a* which displays a setting screen showing various keys for settings, numeric keypad 10*b*, and start key 10*c* which is pressed when copying or scanning is executed. In an embodiment, operation panel 10 accepts a user input specifying the thickness of the sheet P to be subjected to printing and then transmits data describing the input to control unit 1 (refer to FIG. 2) which will be described later. For example, a user may input data specifying a type of paper, such as thick paper, plain paper, and thin paper.

Figure 2:
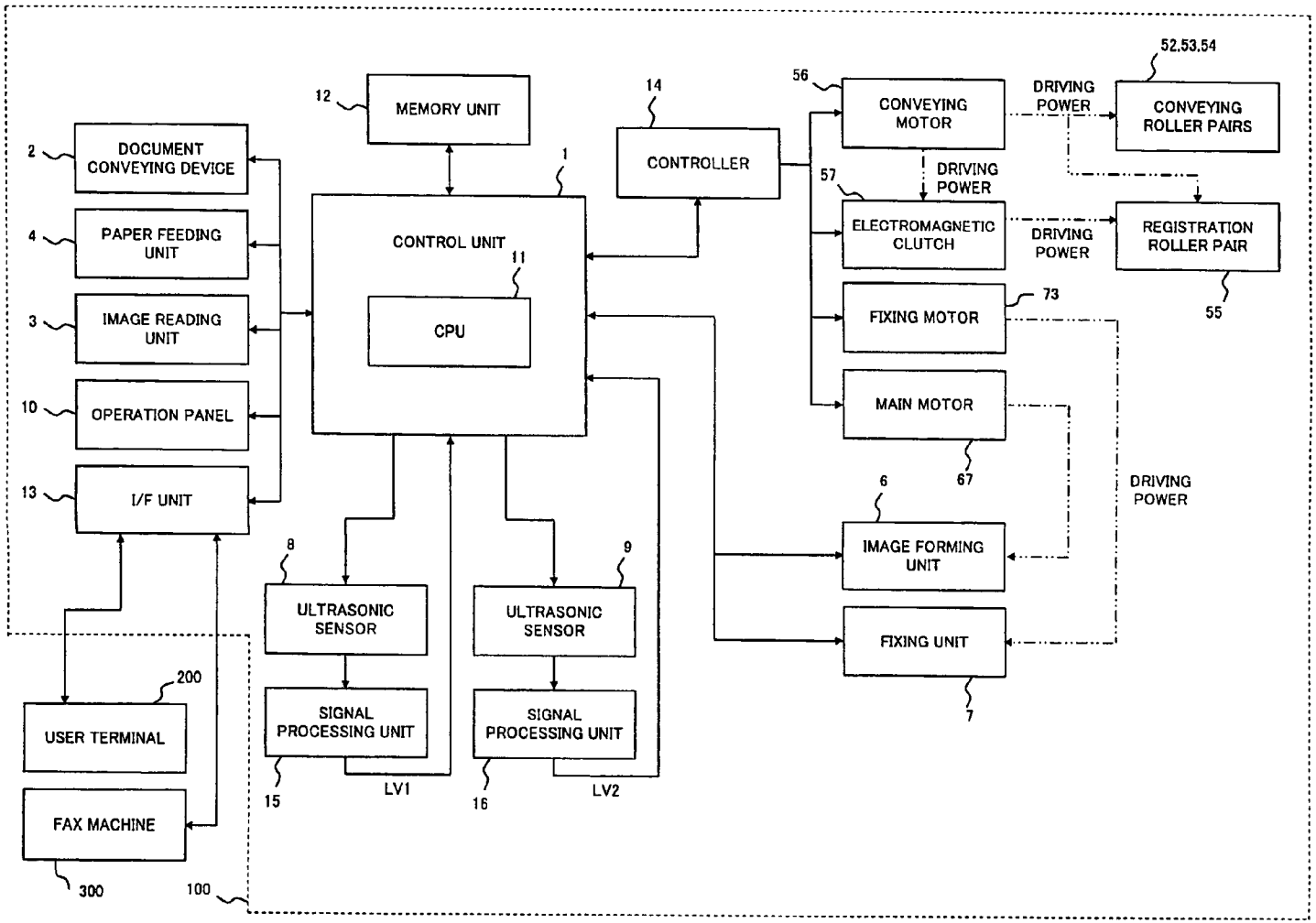
FIG. 2 is a block diagram illustrating the multifunctional peripheral according to the embodiment depicted in FIG. 1.

An embodiment of the hardware configuration of multifunctional peripheral 100 will now be described with emphasis on the sheet conveyance with reference to FIG. 2. FIG. 2 is a block diagram illustrating a hardware configuration of multifunctional peripheral 100 according to an embodiment.

Referring to FIG. 2, multifunctional peripheral 100 includes, in the main body thereof, control unit 1 which includes central processing unit (hereinafter "CPU") 11 and electronic parts (not illustrated) and the like for controlling operations of the entire multifunctional peripheral 100. In control unit 1, CPU 11 functions as a central processor and performs various arithmetic operations on the basis of a program and data stored in memory unit 12 or an input program and data, thus controlling respective components of multifunctional peripheral 100. CPU 11 gives an operation instruction to controller 14 which controls various motors supplying driving power for sheet conveyance in the apparatus. In some embodiments, control unit 1 receives a reception level signal LV1 (first reception level signal) from signal processing unit 15 and a reception level signal LV2 (second reception level signal) from signal processing unit 16. In some embodiments, signal processing units 15, 16 process output voltages of receiving units of ultrasonic sensors. An embodiment of control unit 1 may detect a reception level of each receiving unit to recognize the angle of inclination of a sheet P.

In some embodiments, memory unit 12 may include, but is not limited to random-access memory (hereinafter "RAM"), a hard disk drive (hereinafter "HDD"), read only memory (hereinafter "ROM"), flash memory, a flash ROM, or any other computer storage mechanism known in the art. As depicted in FIG. 2, memory unit 12 is connected to control unit 1. The RAM is a volatile memory and may be used to temporarily develop a control program or control data or temporarily store image data. The HDD is a large-capacity non-volatile memory and may be used to store the control program, the image data, and information regarding user settings of the multifunctional peripheral 100. The flash ROM may store the control program and the control data for the multifunctional peripheral 100. CPU 11 reads the program and data from the memory unit 12 for control and performs control. In an embodiment, memory unit 12 may store data for determining the angle of inclination of a sheet P on the basis of the reception level of the receiving unit of each ultrasonic sensor. Some embodiments may include utilizing multiple member devices in various configurations.

As shown in FIG. 1, an embodiment may include multifunctional peripheral 100 having document conveying device 2, image reading unit 3, paper feeding unit 4, conveying path 5, image forming unit 6, fixing unit 7, and interface (I/F) unit 13. In some embodiments, control unit 1 is connected to document conveying device 2, image reading unit 3, paper feeding unit 4, conveying path 5, image forming unit 6, fixing unit 7, and interface (I/F) unit 13, which constitute multifunctional peripheral 100. In an embodiment, control unit 1 may allow the multifunctional peripheral 100 to communicate with the individual components. Control unit 1 may control operations of the above mentioned components on the basis of, for example, the program stored in memory unit 12.

In an embodiment, I/F unit 13 includes a connector and a socket for connecting to user terminal 200 (e.g., a personal computer) directly or through a network. In some embodiments, I/F unit 13 may include a modem for communicating with a communication target, such as fax machine 300. Accordingly, multifunctional peripheral 100 can receive image data transmitted from user terminal 200 and print an image based on the data (printer function). In various embodiments, multifunctional peripheral 100 can transmit image data read by image reading unit 3 to user terminal 200 (scanner function). In addition, multifunctional peripheral 100 can transmit and receive image data to and from fax machine 300 (fax function).

In some embodiments, multi-functional peripheral 100 may include one or more sensors. Sensors utilized may include any combination of sensors including, but not limited to transceivers, transducers, ultrasonic sensors, photoelectric sensors and/or other sensors known in the art. For example, an embodiment may include multifunctional peripheral 100 having two ultrasonic sensors. As shown in FIG. 1, sensors may include ultrasonic sensor 8 disposed between registration roller pair 55 and conveying roller pair 53 along conveying path 5 and ultrasonic sensor 9 (an example of a second sensor) disposed between fixing unit 7 and image forming unit 6. In some embodiments, sensors may be positioned at various locations along the conveying path. Embodiments may include providing output voltages of the sensors to signal processing units. As shown in FIG. 2, output voltages of ultrasonic sensors 8 and 9 are supplied to signal processing unit 15 (corresponding to a first signal processing unit) and signal processing unit 16 (corresponding to a second signal processing unit), respectively. Signal processing unit 15 processes an output voltage of receiving unit 82 (shown in FIG. 3A) of ultrasonic sensor 8 to output the reception level signal LV1 indicating a reception level of receiving unit 82. As shown in FIG. 2, signal processing unit 16 processes an output voltage of a receiving unit 92 (shown in FIG. 3B) of ultrasonic sensor 9 to output the reception level signal LV2 indicating a reception level of receiving unit 92. The reception level signals are supplied to control unit 1 (CPU 11) as depicted in FIG. 2. In some embodiments, ultrasonic sensors 8 and 9, may be the same type of sensors.

As depicted in FIG. 2, control unit 1 may be connected to controller 14 which controls the various motors for sheet conveyance and image formation. In some embodiments, control unit 1 may provide an instruction to controller 14 for motors to be operated. Controller 14 may control the motors in accordance with the instruction from control unit 1. In some embodiments, control unit 1 may provide all or some of the functionality of controller 14. In some such embodiments, controller 14 may not be needed. For example, controller 14 may be integrated in control unit 1.

In some embodiments, the multifunctional peripheral may include a conveying motor, a main motor, and a fixing motor. For example, as shown in FIG. 2, the motors arranged in multifunctional peripheral 100 may include conveying motor 56 which rotates the conveying roller pairs 52, 53, 54 and the registration roller pair 55, main motor 67 which rotates a member that rotates during printing (e.g., photosensitive drum 61 in image forming unit 6), and fixing motor 73 which rotates heating roller 71 and pressure roller 72 in fixing unit 7. In various embodiments, controller 14 controls an operation of each motor (e.g., ON/OFF of rotation).

Some embodiments may include registration roller pair 55 which may stop a sheet P which is being conveyed, bend the sheet P to correct skew of the sheet, and after that, start rotating such that the rotation corresponds with the formation of the toner image formed by image forming unit 6. Accordingly, registration roller pair 55 may start to rotate at a timing different from the rotation timings of the conveying roller pairs 52, 53, 54. Hence, electromagnetic clutch 57 is provided to control ON/OFF of driving power transmission to registration roller pair 55. In some embodiments, controller 14 turns off electromagnetic clutch 57 when sheet P is not bent sufficiently, thus stopping registration roller pair 55. Various embodiments may include control unit 1 which detects when bending of the sheet P reaches a predetermined threshold level proximate registration roller pair 55 using ultrasonic sensor 8 and turns on electromagnetic clutch 57 to rotate registration roller pair 55 timed to correspond with the formation of the toner image to be transferred. Thus, control 1 unit may control sheet conveyance in the image forming apparatus. For example, in some embodiments control unit 1 may receive reception level signals from processing units 15, 16 and evaluate the bending of the sheet contacting a skew correcting roller pair (e.g., registration roller 55) based on the reception level signals. Based on these evaluations a determination may be made as to whether the sheet P is sufficiently bent for the control unit 1 to cause the skew correcting roller pair to rotate, thereby controlling the conveyance of sheets in the image forming apparatus.

Figure 3A:
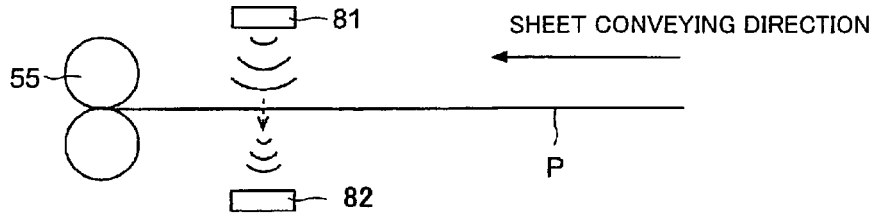
FIG. 3A illustrates the placement of an sensor disposed upstream of a registration roller pair in the embodiment depicted in FIG. 1.
Figure 3B:
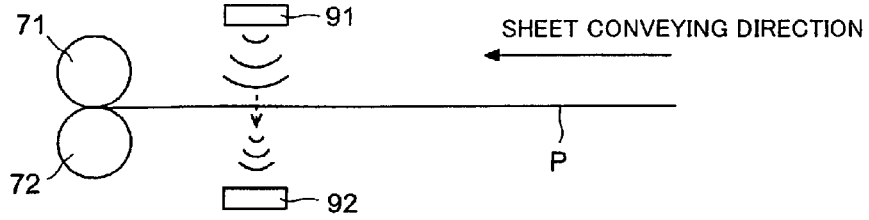
FIG. 3B illustrates the placement of another sensor disposed upstream of a fixing unit.
Figure 3C:
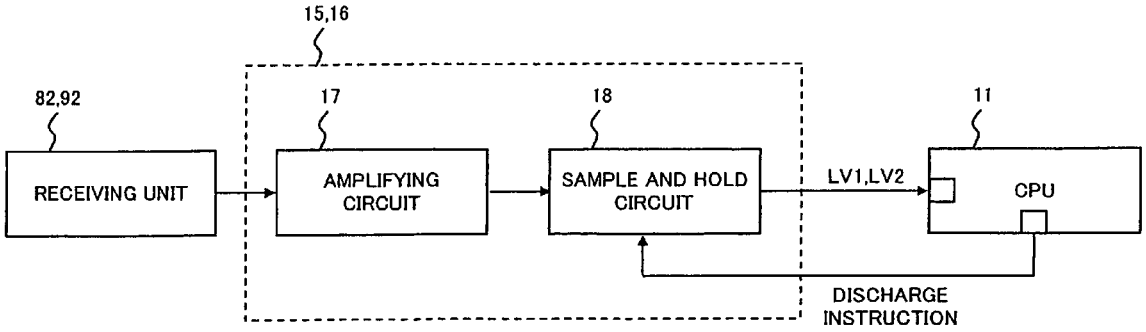
FIG. 3C illustrates a signal processing unit.

FIGS. 3A-3C depict a configuration of each ultrasonic sensor and the corresponding signal processing unit for processing an output voltage of the receiving unit of the ultrasonic sensor. FIG. 3A illustrates the placement of ultrasonic sensor 8. FIG. 3B illustrates the placement of ultrasonic sensor 9. FIG. 3C illustrates embodiments of signal processing units 15, 16.

Explanation of the placement of ultrasonic sensor 8 will now be made with reference to FIG. 3A. As described using FIG. 1, multifunctional peripheral 100 may include ultrasonic sensor 8 disposed between registration roller pair 55 and conveying roller pair 53 along conveying path 5. Accordingly, the rotary members shown on the left of FIG. 3A correspond to registration roller pair 55.

As depicted in FIG. 3A, some embodiments may include ultrasonic sensor 8 having transmitting unit 81 (corresponding to a first transmitting unit) which transmits an ultrasonic wave as a sending signal and receiving unit 82 (corresponding to a first receiving unit) which receives the ultrasonic wave from transmitting unit 81. In ultrasonic sensor 8, transmitting unit 81 and receiving unit 82 each include, for example, a piezoelectric element (for example, piezoelectric ceramic). In some embodiments, transmitting unit 81 applies a voltage between electrodes of the piezoelectric element at a frequency in an ultrasonic range to cause mechanical deformation of the piezoelectric element according to the voltage, so that an ultrasonic wave is emitted from transmitting unit 81. When the propagating ultrasonic wave emitted from transmitting unit 81 is applied to the piezoelectric element in receiving unit 82, a voltage between the electrodes of the piezoelectric element of receiving unit 82 is gained according to the propagating wave.

Referring to FIG. 3A, transmitting unit 81 and receiving unit 82 are arranged such that a transmitting surface of transmitting unit 81 and a detecting surface of receiving unit 82 are opposed to each other and have an interval therebetween such that conveying path 5 is disposed therebetween. For convenience of understanding, the figures illustrate the case where transmitting unit 81 and receiving unit 82 are positioned such that the primary direction for ultrasonic wave transmission and reception is in the direction perpendicular to the sheet conveying direction. In some embodiments, transmitting unit 81 and receiving unit 82 are positioned such that the primary direction of ultrasonic wave transmission and reception by these units is at a slight angle to a plane in the sheet conveying direction. In some embodiments, transmitting unit 81 transmits an ultrasonic wave to a sheet P and receiving unit 82 receives the ultrasonic wave transmitted through the sheet P and transduces the received ultrasonic wave into a corresponding output voltage. Specifically, ultrasonic sensor 8, disposed upstream of registration roller pair 55 in the sheet conveying direction, includes transmitting unit 81 which transmits a ultrasonic wave (an example of the sending signal) and receiving unit 82 which is opposed to transmitting unit 81. In some embodiments, conveying path 5 may be disposed in the interval disposed between transmitting unit 81 and receiving unit 82. Receiving unit 82 may output a voltage depending on the received ultrasonic wave in various embodiments.

Explanation of the placement of ultrasonic sensor 9 will now be made with reference to FIG. 3B. As described using FIG. 1, some embodiments of multifunctional peripheral 100 may include ultrasonic sensor 9 disposed upstream of fixing unit 7 in the sheet conveying direction. Accordingly, rotary members shown on the left of FIG. 3B correspond to heating roller 71 and pressure roller 72.

In some embodiments, ultrasonic sensor 9 may include transmitting unit 91 and receiving unit 92 in a manner similar to ultrasonic sensor 8 (shown in FIG. 3A). In various embodiments, transmitting unit 91 and receiving unit 92 each include a piezoelectric element (for example, piezoelectric ceramic) in a manner similar to ultrasonic sensor 8. Embodiments may include ultrasonic sensor 9 having the same principle of operation as that of ultrasonic sensor 8. In some embodiments, the transmitting unit 91 and the receiving unit 92 are arranged such that a transmitting surface of transmitting unit 91 and detecting surface of receiving unit 92 are opposed to each other and have an interval therebetween such that conveying path 5 through which a sheet P is conveyed is disposed therebetween in a manner similar to ultrasonic sensor 8. In various embodiments, transmitting unit 91 transmits an ultrasonic wave as a sending signal to a sheet P and receiving unit 92 receives the ultrasonic wave transmitted through the sheet P and transduces the received ultrasonic wave into a corresponding output voltage. As shown in FIG. 3B, ultrasonic sensor 9, disposed upstream of fixing unit 7 (shown in FIG. 1) in the sheet conveying direction, includes transmitting unit 91 which transmits an ultrasonic wave and receiving unit 92 which is opposed to transmitting unit 91 such that an interval is formed therebetween. In some embodiments, conveying path 5 through which conveyed sheet P is conveyed is disposed within the interval defined by the transmitting unit 91 and receiving unit 92. Some embodiments include a receiving unit which is capable of outputting a voltage depending on the received ultrasonic wave.

As is shown in FIG. 2, respective signal processing units for processing signals, serving as output voltages of the receiving units 82, 92 (shown in FIGS. 3A-3B) supply the resultant signals to CPU 11. Signal processing units 15, 16 will now be described with reference to FIG. 3C. In some embodiments, signal processing unit 15 for processing an output voltage of receiving unit 82 may be the same as signal processing unit 16 for processing an output voltage of receiving unit 92. In the following description, ultrasonic sensors 8, 9 will be described together. As shown in FIG. 3C, the components of signal processing unit 15 and those of signal processing unit 16 are designated by the same reference numerals.

As depicted in FIG. 3C, signal processing units 15, 16 each include amplifying circuit 17 and sample and hold circuit 18 and the like. An output voltage of each receiving unit 82, 92 is supplied to amplifying circuit 17 so that the amplitude of the voltage is amplified. In some embodiments, amplifying circuit 17 is connected to sample and hold circuit 18. Various embodiments of sample and hold circuit 18 may include a capacitor. Sample and hold circuit 18 may charge the capacitor included in circuit 18 with an output signal of amplifying circuit 17. As described above, some embodiments of sample and hold circuit 18 may convert an output signal of the amplifying circuit 17 into DC (direct current) and holds the DC level for a predetermined period of time. An output terminal of sample and hold circuit 18 is connected to an A/D conversion port (an A/D converter may be provided) of CPU 11. In various embodiments, CPU 11 acquires an output of sample and hold circuit 18 at arbitrary intervals. In other words, reception level signal LV1 indicating a reception level of receiving unit 82 and reception level signal LV2 indicating a reception level of receiving unit 92 are supplied to CPU 11. CPU 11 may recognize the reception levels of receiving units 82, 92 in this manner. In some embodiments, CPU 11 receives an output voltage of sample and hold circuit 18 in signal processing unit 15 as reception level signal LV1 indicating a reception level of receiving unit 82. CPU 11 further receives an output voltage of sample and hold circuit 18 in signal processing unit 16 as reception level signal LV2 indicating a reception level of receiving unit 92. Each sample and hold circuit 18 can discharge the capacitor included therein in accordance with a signal output from CPU 11 at arbitrary intervals.

Examples of the angle of inclination of a bent sheet P and examples of a change in reception level of the ultrasonic sensor will be described with reference to FIGS. 4 to 5E. FIGS. 4A to 4C are diagrams depicting examples of bending of the sheet P contacting registration roller pair 55 and examples of inclination of the sheet P in an embodiment. FIGS. 5A to 5E illustrate examples of a change in reception level of the ultrasonic sensor in association with the angle of the inclination of the sheet P in an embodiment. Hereinafter, the phrase "the angle of the inclination of the sheet P" means "an angle of the inclination of the sheet P relative to the conveying direction of the sheet P". FIG. 5A illustrates a reception level of the ultrasonic sensor when the angle of inclination of the sheet P is 0 degrees. FIG. 5B illustrates a reception level of the ultrasonic sensor when the angle of inclination is 10 degrees. FIG. 5C illustrates a reception level of the ultrasonic sensor when the angle of inclination is 20 degrees. FIG. 5D illustrates a reception level of the ultrasonic sensor when the angle of inclination is 30 degrees. FIG. 5E illustrates a reception level of the ultrasonic sensor when the angle of inclination is 40 degrees.

In some embodiments, as shown in FIG. 1 ultrasonic sensor 8 is disposed upstream of registration roller pair 55 and ultrasonic sensor 9 is disposed upstream of fixing unit 7. Since detection method of the inclination of a sheet P by ultrasonic sensor 8 is the same as that by ultrasonic sensor 9, the determination of the angle of inclination by ultrasonic sensor 8 will now be described as an example.

Figure 4A:
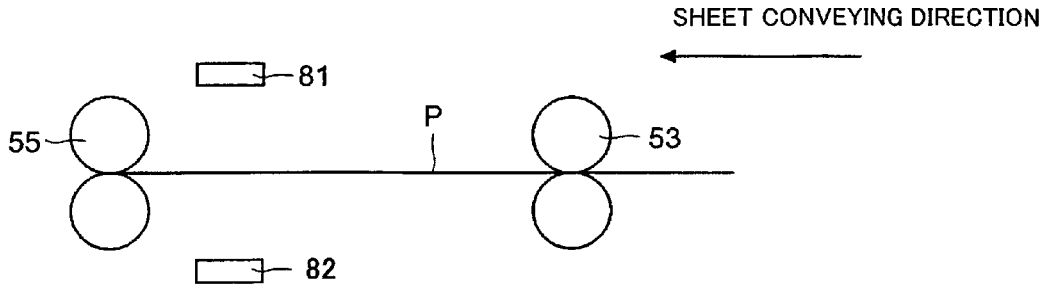
FIGS. 4A to 4C are diagrams showing examples of bending of a sheet contacting the registration roller pair and the angle of inclination of the sheet in an embodiment.

Referring to FIG. 4A, a sheet P conveyed to registration roller pair 55 contacts registration roller pair 55 which is stopping. In some embodiments, conveying roller pair 53, disposed upstream of registration roller pair 55 for conveying the sheet P, continues to convey the sheet P. Although the sheet P tends to enter the nip of registration roller pair 55, the sheet P starts bending because registration roller pair 55 is stopping. Accordingly, the bending causes the sheet P to protrude in the direction perpendicular to the conveying direction of the sheet P, thus causing an inclination of the sheet P, indicated as angle of inclination θ in FIGS. 4B and 4C, relative to the conveying direction of the sheet P.

Figure 4B:
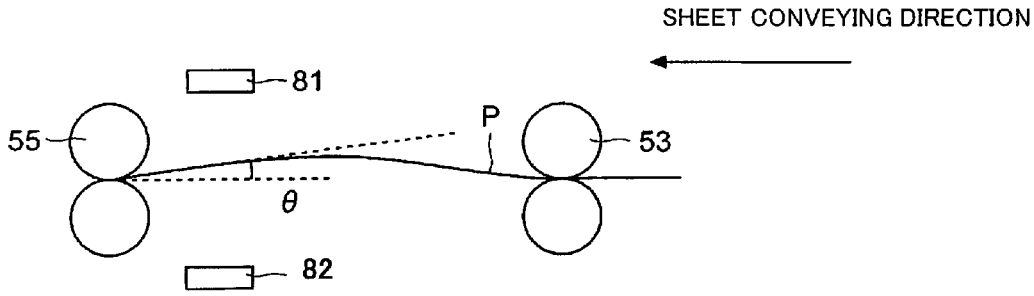
Figure 4C:
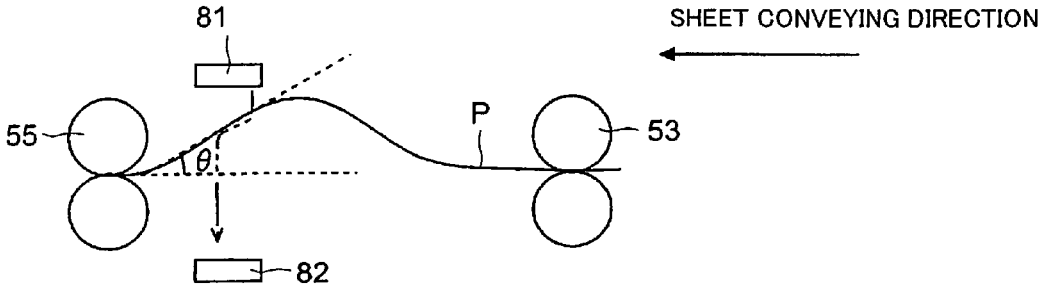
Figure 5A:
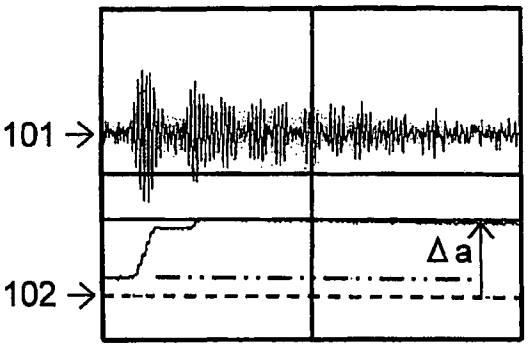
FIGS. 5A to 5E are diagrams illustrating a change in reception level of the sensor with respect to an angle of inclination of the sheet in the embodiment depicted in FIG. 1.
Figure 5B:
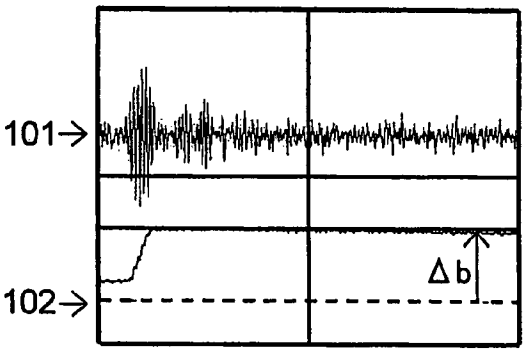
Figure 5C:
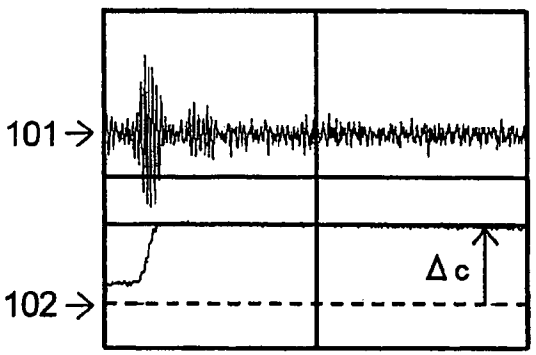
Figure 5D:
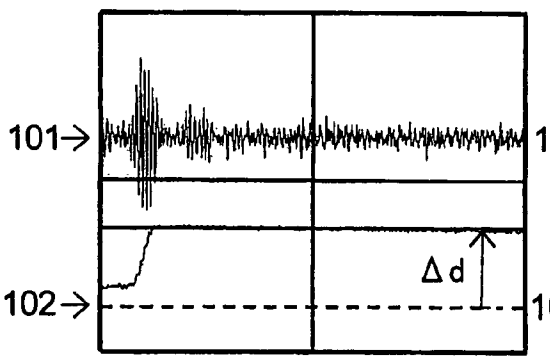
Figure 5E:
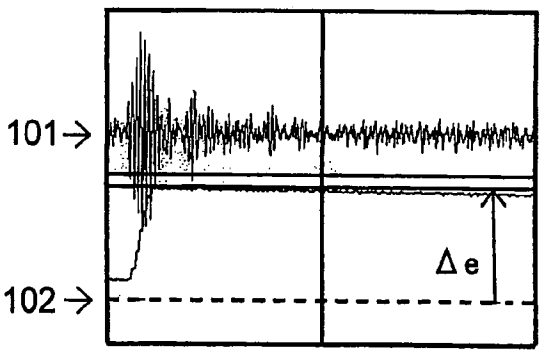

When the conveying roller pair 53 further continues to convey the sheet P in a state shown in FIG. 4B, the extent of bending of the sheet P increases, thus increasing the angle of inclination θ of the sheet P relative to the conveying direction. In some embodiments, when the sheet P is bent sufficiently, the elasticity of the sheet P may cause the leading edge of the sheet P on the upstream side in the conveying direction to fit into the nip of registration roller pair 55. Consequently, skew of the sheet P which is being conveyed is corrected.

Examples of a change in reception level of receiving unit 82 in association with the angle of the inclination caused in the sheet P will now be described with reference to FIGS. 5A to 5E. In some embodiments as shown in FIGS. 5A to 5E, an upper waveform 101 is a waveform obtained by amplifying an output voltage of receiving unit 82 (shown in FIGS. 4A-4C) with the amplifying circuit 17 (shown in FIG. 3C). As depicted in FIGS. 5A to 5E, a lower waveform is an output waveform of sample and hold circuit 18. A straight line overlapping the lower waveform is an average potential level of the output of sample and hold circuit 18. A dashed line 102 at approximately 0 V in terms of potential may be used as a reference value for the average level of the lower waveform. FIGS. 5A to 5E illustrate waveforms obtained when transmitting unit 81 emits the ultrasonic wave to a plain paper.

For example, when FIG. 5B (where the angle of inclination is 10 degrees) is compared to FIG. 5E (where the angle of inclination is 40 degrees), an average level of the output voltage of the sample and hold circuit 18 in FIG. 5E is clearly higher than that in FIG. 5B. In other words, as the angle of inclination θ of the sheet P becomes larger, a voltage of the reception level signal LV1 supplied to the CPU 11 becomes higher. Therefore, the control unit 1 recognizes an increase in the angle of inclination θ of the sheet P.

Referring to FIGS. 5B to 5E, Δb is the difference between the average level of the lower waveform and dashed line 102 in FIG. 5B, Δc is the difference between the average level of the lower waveform and dashed line 102 in FIG. 5C, Δd is the difference between the average level of the lower waveform and dashed line 102 in FIG. 5D, and Δe is the difference between the average level of the lower waveform and dashed line 102 in FIG. 5E. When the differences in the figures are compared, it is found that $\Delta b<\Delta c<\Delta d<\Delta e$. In other words, the larger the angle of the inclination θ of the sheet P, the higher the average level of the output voltage of receiving unit 82 (i.e. a voltage of the reception level signal LV1). It is also clear from the fact that the amplitude of the amplified waveform with amplifying circuit 17 increases as the angle of inclination θ of the sheet P increases (as shown by the transition from FIG. 5B to FIG. 5E).

In some embodiments, the reception level of each receiving unit increases as the angle of inclination θ of the sheet P increases, as is described below in reference to FIG. 4C. The attenuation of an ultrasonic wave in the air is larger than the attenuation of an ultrasonic wave that propagated through the sheet. As depicted in FIG. 4C, an ultrasonic wave output from transmitting unit 81 includes a component that hits a sheet P and propagates through the sheet P and is then released toward the corresponding receiving unit 82, as shown by a double-dashed line. When the angle of inclination θ of the sheet P increases, the sheet P moves closer to the transmitting unit 81 or the receiving unit 82 depending on the direction of bending, thus increasing the component that propagates through the sheet P and then reaches the receiving unit 82. Conceivably, therefore, the larger the angle of inclination θ of the sheet P, the higher the reception level of receiving unit 82.

In FIG. 5A illustrating that the angle of inclination 8 of the sheet P is 0 degree, Δa denoting the difference between the average level of the lower waveform and the dashed line 102 is substantially the same as Δc. In some embodiments, this may be due to sheet P being parallel to the detecting surface of the receiving unit 82 of the ultrasonic sensor 8, thus, an ultrasonic wave is reflected between the receiving unit 82 and the sheet P two or more times. An output voltage of receiving unit 82 increases as the ultrasonic wave reciprocates due to reflection (see the upper amplified waveform in FIG. 5A).

In some embodiments, control unit 1 (and/or CPU 11) detects the amplitude of reception level signal LV1 from signal processing unit 15 to recognize a reception level of receiving unit 82, thereby determining the angle of inclination θ of the sheet P. For example, if it is necessary to bend the sheet P so as to form an inclination at an angle of 40 degrees, CPU 11 can detect that the sheet P is bent such that the angle of inclination θ of the sheet P is approximately 40 degrees. In some embodiments, when CPU 11 detects that reception level signal LV1 supplied to CPU 11 has average level having a potential difference from the dashed line 102 approximately equal to Δe, CPU 11 can detect that the sheet P is bent such that the angle of inclination θ of the sheet P is approximately 40 degrees. In some embodiments, ultrasonic sensor 9 functions in a similar manner. For example, control unit 1 (and/or CPU 11) detects the magnitude of reception level signal LV2 from signal processing unit 16 to recognize the reception level of receiving unit 92, so that control unit 1 can detect whether the sheet P is bent or not upstream of fixing unit 7 in conveying path 5.

In some embodiments, the reception level of each receiving unit may vary depending on the thickness of a sheet P even when the sheet is bent at the same angle. Hence, an experiment may be performed in order to recognize a reception level of each receiving unit in association with the angle of inclination θ for each of types of sheets, for example, thick paper, plain paper, and thin paper. A data table showing the relationship between the magnitude of a reception level signal of each receiving unit and the angle of inclination θ of each sheet in association with the thickness of the sheet may be created on the basis of data obtained by the experiment and may be stored in the memory unit 12. In various embodiments, when the user inputs the kind of sheet (thickness of the sheet) to be printed by using touch panel liquid crystal display 10*a*, control unit 1 reads out the data relating to the angle of inclination θ of the sheet to be printed from memory unit 12. Therefore, control unit 1 may recognize the angle of inclination θ of a sheet P.

In the above description, the angle of inclination θ of a sheet P may be detected on the basis of a reception level of the receiving unit as an example of the present embodiment. Since the reception level of the receiving unit changes in a continuous manner, the state of a sheet P can also be detected on the basis of the tendency of the amount of change in reception level.

In some embodiments, sensors, such as ultrasonic sensors may be capable of detecting when multiple sheets are fed. An example of multiple sheets feeding detection by ultrasonic sensor 8 will now be described using FIG. 5A. When multiple sheets feeding occurs such that a plurality of sheets P are conveyed in the stacking state, the amplitude of the ultrasonic wave which reaches receiving unit 82 is reduced because the two or more sheets P absorb the ultrasonic wave. Accordingly, reception level signal LV1 (a voltage of the reception level signal) supplied to CPU 11 may be reduced. For example, reception level signal LV1 may be reduced to a level shown in FIG. 5A as a doubled dashed line. In some embodiments, a threshold value for the magnitude of reception level signal LV1 for detecting the multiple sheets feeding may be set (and then may be stored in, for example, memory unit 12). When reception level signal LV1 falls below the threshold value, control unit 1 may determine the occurrence of multiple sheets feeding.

In various embodiments, control unit 1 can detect the occurrence of multiple sheets feeding using ultrasonic sensor 8. Since the occurrence of multiple sheets feeding can be detected using ultrasonic sensor 8, control unit 1 may not detect multiple sheets feeding on the basis of a reception level of the ultrasonic sensor 9 (though multiple sheets feeding can be detected on the basis of a reception level of ultrasonic sensor 9 in a manner similar to the case using the ultrasonic sensor 8).

Figure 6:
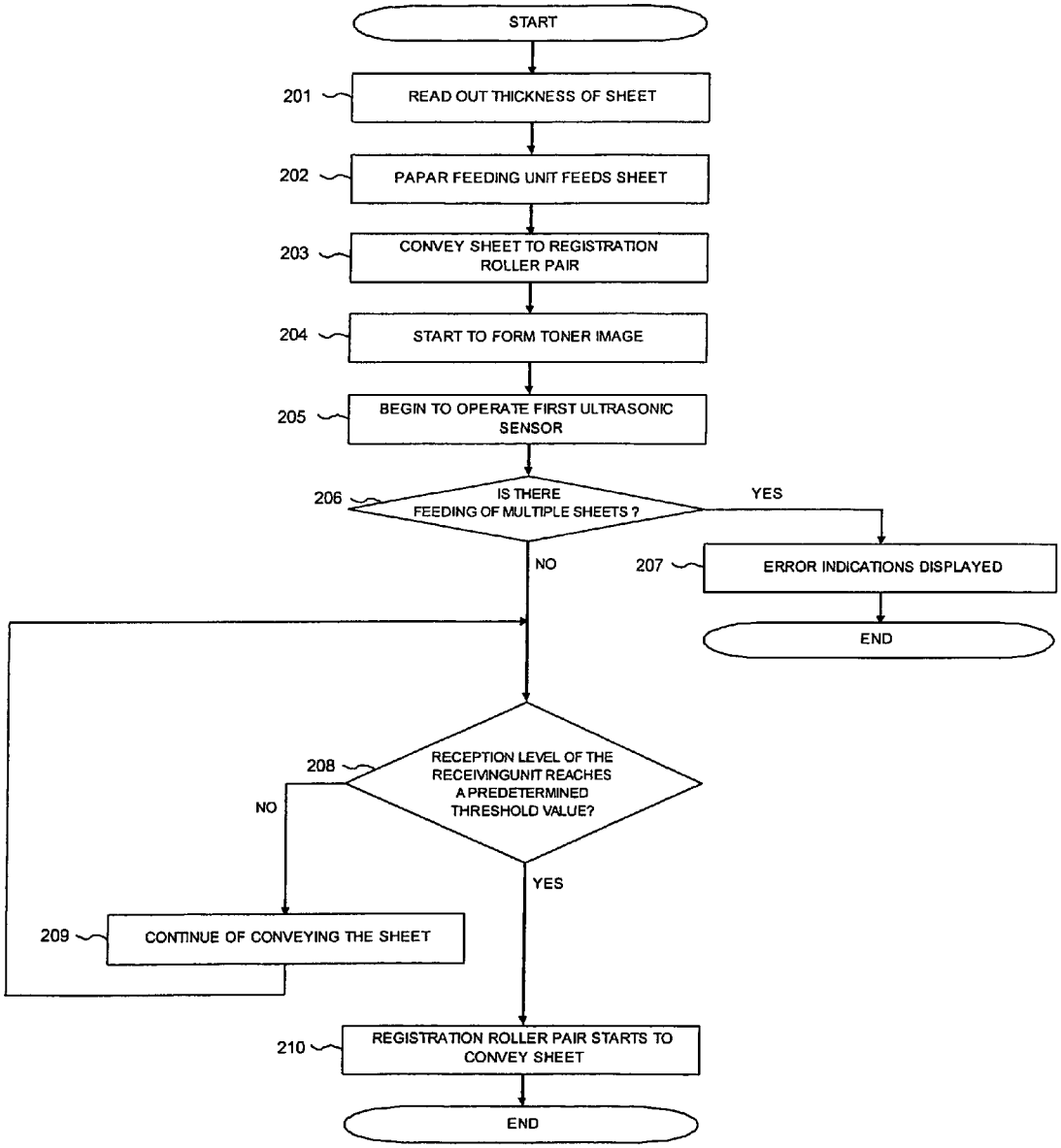
FIG. 6 is a flowchart depicting control for conveying a sheet during printing until the registration roller pair is driven in an embodiment.
Figure 7:
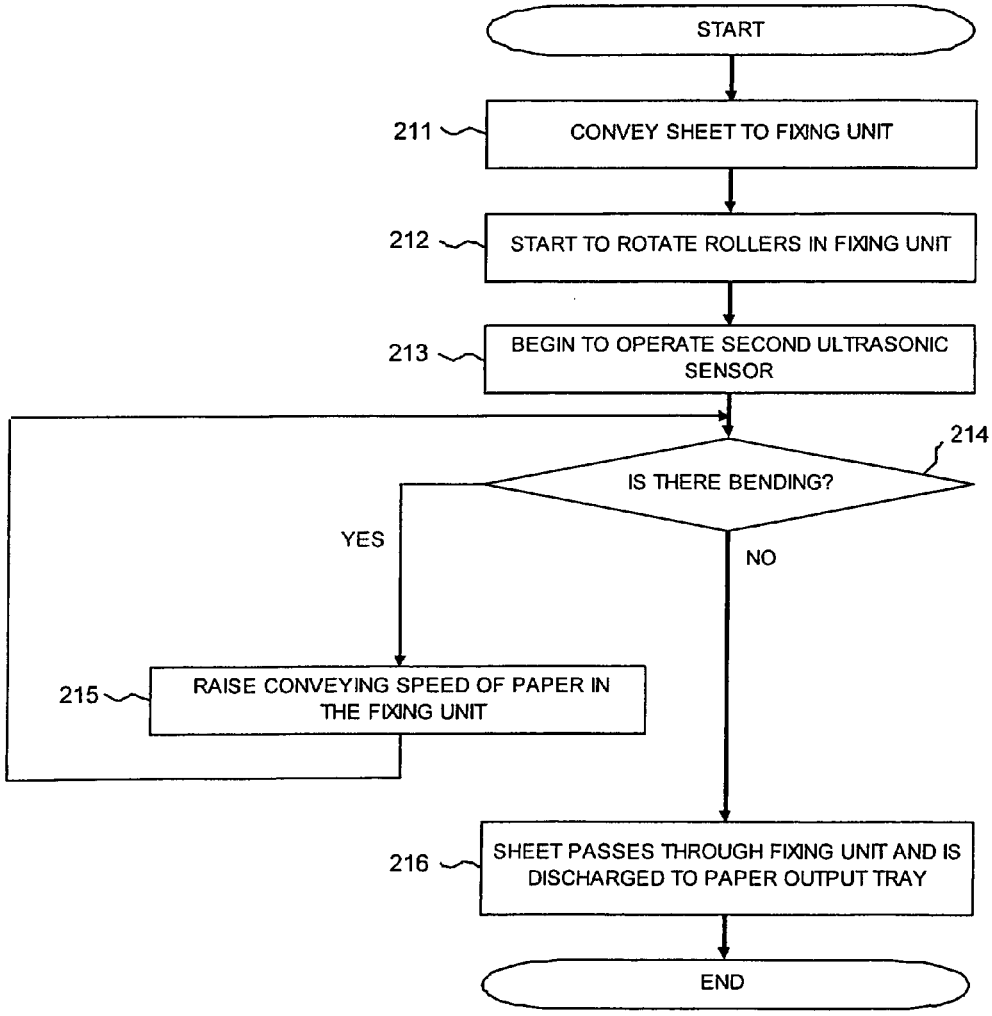
FIG. 7 is a flowchart depicting control for conveying a sheet during printing after the registration roller pair is driven in an embodiment.

An example of control for conveying the sheet P during printing will be described with reference to FIGS. 6 and 7. FIG. 6 is a flowchart illustrating control for conveying the sheet P during printing until registration roller pair 55 is driven. FIG. 7 is a flowchart illustrating control for conveying the sheet P during printing after the registration roller pair 55 is driven.

Although the processes depicted in FIGS. 6 and 7 are continuously performed, the processes will be explained in a step-like manner.

For ease of understanding, the process will be described below with respect to printing on one sheet P. When successive printing is performed, a series of control steps in FIG. 6 and that in FIG. 7 may be performed concurrently.

As depicted in FIG. 6, printing of the printer function or the copier function may be started (START). In some embodiments, control unit 1 reads out the thickness of a sheet P to be subjected to printing which stored in memory unit 12 (step 201). In some embodiments, sheets P accommodated in paper feeding unit 4 tend to be consistent. When the thickness of sheet P accommodated in paper feeding unit 4 is set once, the set thickness of sheet P is stored into memory unit 12. Sheets may be handled on the assumption that the sheets have the same thickness as that set in the past printing unless the thickness is newly set. If the thickness of a sheet P to be subjected to printing is set on the basis of an input on operation panel 10 before the start of printing or print setting data transmitted from user terminal 200, control unit 1 determines that a sheet P having a newly set thickness is to be subjected to printing.

In various embodiments, control unit 1 allows paper feeding unit 4 to feed a sheet P (step 202) and rotates conveying roller pair 53 (shown in FIG. 1) and the like to convey the sheet P to registration roller pair 55 (step 203). Some embodiments may include allowing control unit 1 to allow image forming unit 6 to start to form a toner image (step 204). In some embodiments, control unit 1 may begin to operate ultrasonic sensor 8 (corresponding to a first sensor) disposed upstream of registration roller pair 55, allowing transmitting unit 81 to transmit an ultrasonic wave, and may begin to detect the reception level of receiving unit 82 (step 205).

In some embodiments, control unit 1 determines, on the basis of the reception level of receiving unit 82, whether multiple sheets feeding has occurred or not (step 206). When multiple sheets feeding has been detected ("YES" in step 206), error indication indicating that multiple sheets feeding has occurred is displayed on liquid crystal display 10*a* (shown in FIG. 1) of operation panel 10 (shown in FIG. 1) because the probability of occurrence of a jam is high and the possibility of reprinting is raised. Control unit 1 stops operating ultrasonic sensor 8 (step 207). To remove sheets P fed in the stacked state from conveying path 5, the process is temporarily terminated (END).

As shown in FIG. 6, when multiple sheets feeding is not detected ("NO" in step 206), control unit 1 determines, on the basis of the data table in memory unit 12, whether a reception level of receiving unit 82 reaches a predetermined threshold level (e.g., a voltage of reception level signal LV1 reaches a predetermined value) (step 208). The thicker the thickness of the sheet P, the lower the pressure of the ultrasonic wave which reaches receiving unit 82. In some embodiments, control unit 1 can determine, on the basis of the sheet thickness, that the sheet P is bent sufficiently so that skew of the sheet P can be corrected. In other words, a predetermined threshold level for a thick sheet is lower than a predetermined threshold level for a thin sheet.

When control unit 1 determines that the reception level does not reach the predetermined level ("NO" in step 208), conveyance of the sheet P contacting registration roller pair 55 with conveying roller pair 53 is continued so that the sheet is satisfactorily bent (step 209). Specifically, when multiple sheets feeding is not detected, control unit 1 continues conveying the sheet P with conveying roller pair 53 until control unit 1 determines that the reception level of receiving unit 82 reaches the predetermined threshold level. After that, the process is returned to step 206. Whereas, when control unit 1 determines that the reception level of receiving unit 82 reaches the predetermined threshold level ("YES" in step 208), control unit 1 stops conveying the sheet with conveying roller pair 53 and operating ultrasonic sensor 8 and then starts conveying the sheet P from registration roller pair 55 (conveying roller pair 53 and registration roller pair 55 start rotating) in timing with the formation of the toner image to be transferred (step 210). As described above, control unit 1 detects the occurrence of multiple sheets feeding on the basis of the reception level of the receiving unit 82 of the ultrasonic sensor 8. In some embodiments, control unit 1 may also determine the angle of inclination θ of the sheet P bent relative to the sheet conveying direction while contacting registration roller pair 55.

Conveying control after the start of sheet conveyance with registration roller pair 55 (START) will be described with reference to FIG. 7. After the start of sheet conveyance with the registration roller pair 55, the toner image is transferred onto the sheet P and the resultant sheet is conveyed to fixing unit 7 (step 211). In fixing unit 7, rotating of heating roller 71 and pressure roller 72 is started (step 212). Rotating the rollers in fixing unit 7 may be started until the process reaches step 212, for example, simultaneously with the start of printing.

Control unit 1 begins to operate ultrasonic sensor 9 (corresponding to a second sensor) disposed upstream of fixing unit 7, allows transmitting unit 91 to transmit an ultrasonic wave, and detects the reception level of receiving unit 92 (step 213). Control unit 1 then determines whether or not there is bending upstream of fixing unit 7 (step 214).

If bending of the sheet P has occurred ("YES" in step 214), the reception level of receiving unit 92 becomes higher (for example, a voltage of the reception level signal LV2 becomes higher than that obtained when the sheet has arrived at fixing unit 7). In other words, a conveying speed in fixing unit 7 (the peripheral velocity of heating roller 71 and pressure roller 72) is lower than a conveying speed in image forming unit 6 (the peripheral velocity of photosensitive drum 61 or transfer roller 65). Accordingly, control unit 1 raises the rotational speed of fixing motor 73 to increase the conveying speed in fixing unit 7 (step 215). Specifically, control unit 1 detects, on the basis of the reception level of receiving unit 92, whether the sheet P entering fixing unit 7 is bent. If control unit 1 detects the occurrence of bending, the control unit 1 allows fixing unit 7 to raise the sheet conveying speed. Then, the process is returned to step 213. Thus, the result of detection of the occurrence of bending of the sheet P is fed back. The conveying speed in fixing unit 7 is raised in a stepwise manner until bending is not detected.

When control unit 1 determines that bending of the sheet P has not occurred ("NO" in step 214), conveyance of the sheet P continues in fixing unit 7 without changing the conveying speed in fixing unit 7. The sheet P passes through fixing unit 7 and is finally discharged to paper output tray 51. Then, control unit 1 stops operating ultrasonic sensor 9 (step 216→END).

As described above, in multifunctional peripheral 100 according to an embodiment, transmitting unit 81 (the first transmitting unit) and receiving unit 82 (the first receiving unit) are arranged such that conveying path 5 through which the sheet P is conveyed is disposed therebetween. If multiple sheets feeding of sheets P occurs, a reception level of receiving unit 82 is reduced by the sheets P, so that the occurrence of multiple sheets feeding can be detected by ultrasonic sensor 8 (the first sensor). In addition, it is empirically found that a reception level of receiving unit 82 increases with increasing the angle of inclination θ of a sheet P relative to the sheet conveying direction. Accordingly, the angle of inclination θ of a sheet P due to bending of the sheet P, namely, the extent of bending of the sheet P can be determined on the basis of a reception level of receiving unit 82. Thus, in some embodiments control unit 1 may evaluate bending of the sheet according to a predetermined relationship between the angle of inclination of the sheet and a reception level signal. In various embodiments, ultrasonic sensor 8 may have a function of detecting feeding multiple sheets and/or a function of determining the angle of inclination of a sheet P. Thus, it may be unnecessary to provide a sensor for detecting feeding of multiple sheets and a sensor for determining the angle of inclination of a sheet, namely, two different sensors. Thus, the necessary space and the manufacturing cost can be reduced.

In addition, registration roller pair 55 can properly bend the sheet P in order to correct the skew of a sheet P to such an extent that folding does not occur due to excessive bending. Since the pressure of a ultrasonic wave that is emitted from transmitting unit 81 and reaches receiving unit 82 varies depending on the thickness of a sheet P even if the angle of inclination of the sheet P is same, the thickness of a sheet P to be used can be specified in accordance with an input on the input unit (operation panel 10) with the above-described configuration. In some embodiments, the specified thickness may be used to determine a predetermined value for a ratio calculated by dividing a reception level of a receiving unit (a voltage of reception level signal LV1) by a reference value. Thus, irrespective of the thickness of a sheet P to be used, the sheet P can be properly bent with registration roller pair 55. In addition, bending of the sheet P entering fixing unit 7 can be detected on the basis of a reception level of receiving unit 92 (the second receiving unit). The result of detection of bending of the sheet P is fed back to raise a sheet conveying speed in fixing unit 7, thus removing bending of the sheet P entering fixing unit 7. Accordingly, an occurrence of Z-shaped folding of the sheet P or the occurrence of a jam can be reduced. In some embodiments, Z-shaped folding of the sheet P and/or the occurrence of a jam may be prevented.

In an embodiment, the case where the position in which bending is controlled or detected is the position of the registration roller pair has been described as an example. The position is not limited to that of the registration roller pair. The position of another roller pair may be used so long as the roller pair can be used to adjust skew of the sheet P. In some embodiments, any roller pair may be used so long as the roller pair can correct skew of the sheet P.

Figure 8:
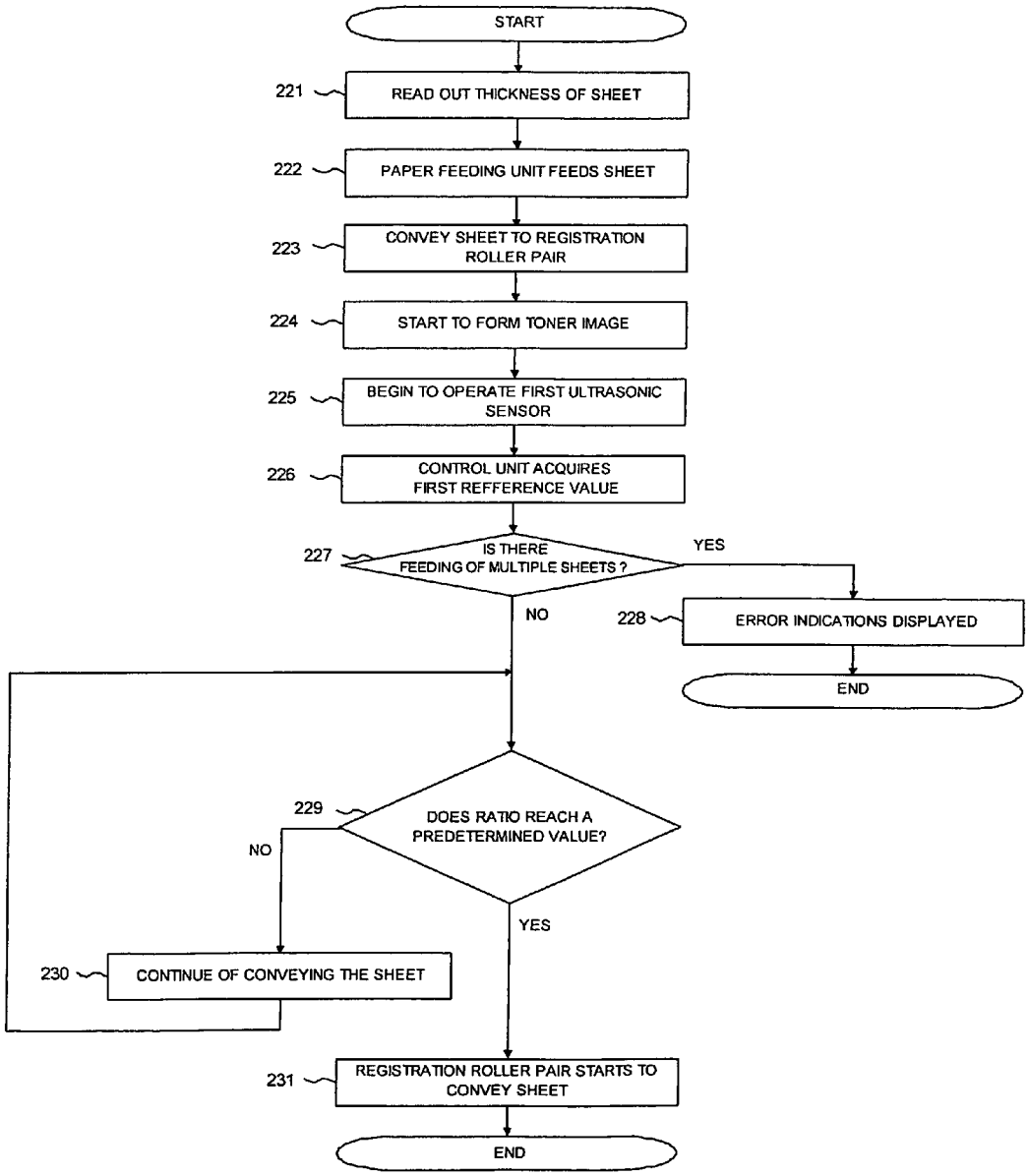
FIG. 8 is a flowchart depicting control for conveying a sheet during printing until the registration roller pair is driven in an embodiment.
Figure 9:
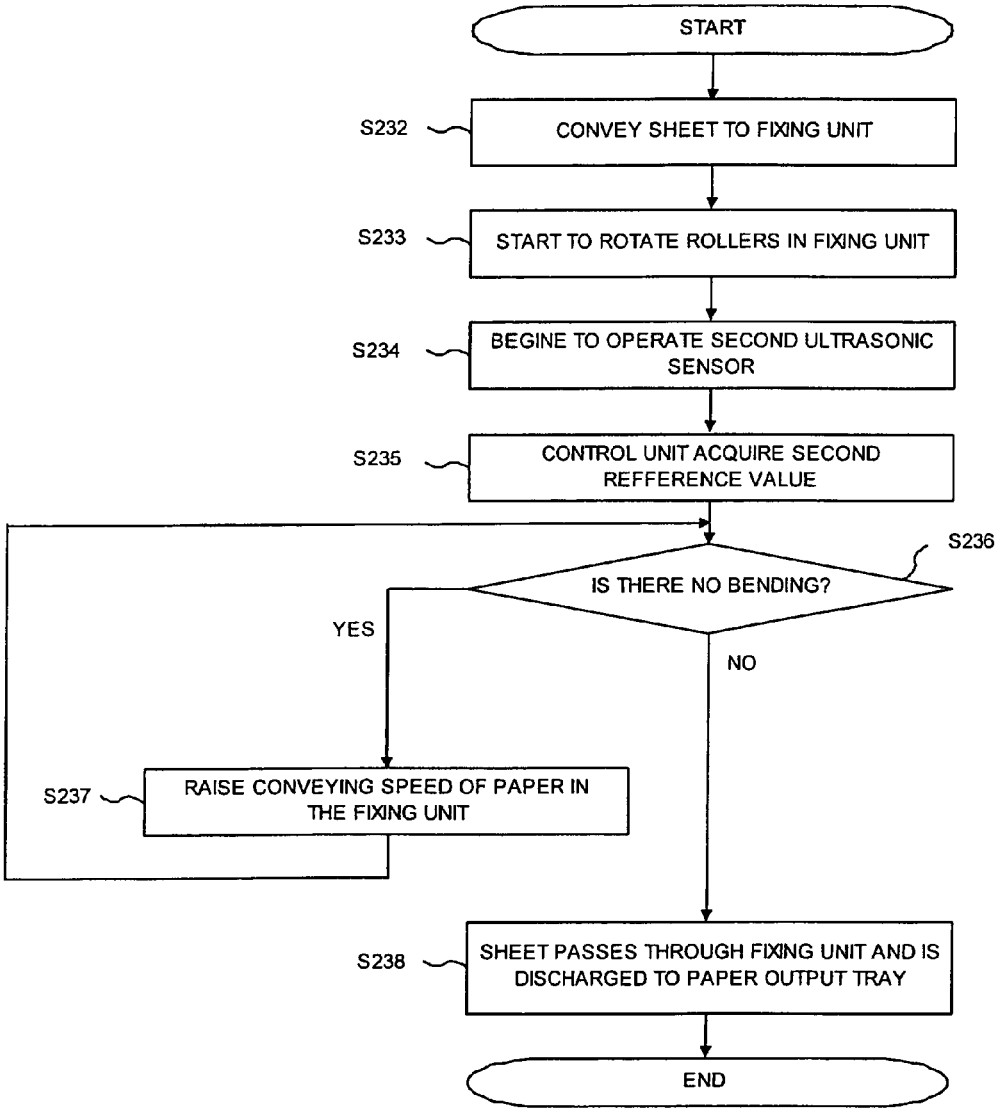
FIG. 9 is a flowchart depicting control for conveying a sheet during printing after the registration roller pair is driven in an embodiment.

An embodiment of the multifunctional peripheral 100 will be described with reference to FIGS. 8 and 9. FIG. 8 is a flowchart illustrating control for conveying a sheet P during printing until registration roller pair 55 is driven. FIG. 9 is a flowchart illustrating control for conveying a sheet P during printing after registration roller pair 55 is driven.

Although the processes of FIGS. 8 and 9 are continuously performed, the processes will be described in a step-wise manner. The control in printing on one sheet P will be described below.

In some embodiments, the angle of inclination of a sheet P is detected on the basis of the magnitude of a reception level of either receiving unit 82, 92 of either ultrasonic sensor 8, 9. Since the relationship between a reception level of each receiving unit 82, 92 and the angle of inclination of the paper P varies depending on the thickness of a sheet, a sheet thickness set using operation panel 10 or user terminal 200 is read out and the angle of inclination of a sheet P is determined on the basis of a reception level of each receiving unit according to the set sheet thickness using the data table described above.

It is noted that an output voltage of each receiving unit increases as the angle of inclination of a sheet P increases, irrespective of the thickness of the sheet P. According to an embodiment, the ratio of reception levels of each receiving unit (the standard of comparison is a reception levels at the time when the sheet P begins to contact registration roller pair 55) is calculated and the angle of inclination of a sheet P is determined. In some embodiments, the angle of inclination of a sheet P is determined using a ratio of reception levels at each receiving unit.

When determining the angle of inclination using a ratio of reception levels at each receiving unit, the configuration of the multifunctional peripheral 100 may be similar to that used when determining the angle of inclination using the magnitude of the reception levels at each receiving unit. The common components in these approaches are designated by the same reference numerals.

Control for conveying a sheet P when determining angle of inclination of a sheet P using a ratio of reception levels will be described using FIGS. 8 and 9. "START" in FIG. 8 is the printing start time point. As shown, control unit 1 reads out the thickness of a sheet P to be subjected to printing which stored in memory unit 12 (step 221, referred to as step 201 in FIG. 6). The thickness of the sheet may be determined with reference to an input on operation panel 10 before the start of printing or print setting data regarding the thickness of the sheet P to be subjected to printing transmitted from user terminal 200 in a manner similar to that described in above.

Since steps 222 to 225 are the same as steps 202 to 205 described above in reference to FIGS. 6-7, explanation thereof is omitted. In some embodiments, control unit 1 acquires a first reference value for ratio calculation. The first reference value is the reception level of receiving unit 82 (i.e. a voltage of reception level signal LV1) detected when the sheet P reaches registration roller pair 55 (e.g., when the inclination of the sheet P relative to the conveying direction is 0 degree) (step 226).

After that, in various embodiments, control unit 1 determines, on the basis of a reception level of receiving unit 82, whether or not there is feeding of multiple sheets (step 227). When multi sheets feeding is detected ("YES" in step 227), an error indication is displayed (step 228). The process is then terminated at "END". Since steps 227 and 228 are the same as steps 206 and 207 described above, detailed explanation thereof is omitted.

In an embodiment, where multi sheets feeding is not detected ("NO" in step 227, control unit 1 further determines whether a ratio calculated by dividing a reception level of receiving unit 82 (a voltage of reception level signal LV1) by the above-described first reference value reaches a predetermined value (step 229). Since the reception level of receiving unit 82 increases as the angle of inclination of a sheet P increases, the predetermined value should be set a value which is larger than 1. In other words, when feeding of multiple sheets is not detected, control unit 1 does not determine the magnitude of a reception level of the receiver 82, but rather calculates the ratio of a reception level of receiving unit 82 determined during continuous rotation of conveying roller pair 53 to a first reference value. In some embodiments, control unit 1 allows conveying roller pair 53 to continue conveying the sheet P until the ratio reaches the predetermined value.

When control unit 1 determines that the ratio does not reach the predetermined value ("NO" in step 229), conveying of the sheet P with conveying roller pair 53 is continued (step 230). After that, the process is returned to step 229. In an embodiment, when the control unit determines that the ratio reaches the predetermined value ("YES" in step 229), this means that the sheet P is satisfactorily bent, control unit 1 stops conveying the sheet with conveying roller pair 53 and, after that, starts conveying the paper P from registration roller pair 55 (conveying roller pair 53 and registration roller pair 55 start rotating) in timing with the formation of the toner image to be transferred (step 231).

The elasticity of thin paper differs from the elasticity of thick paper. For example, assuming that thick paper, such as a postcard or the front cover of a book, and plain paper (OA paper) are bent to the same extent, the force of the thick paper which causes the paper to return to its original state (bending-free state) is stronger than the force of the thin paper. In other words, thin paper and thick paper have different elasticities relative to the same amount of bending. In addition, in some embodiments when thick paper is excessively bent, the thick paper is folded. For skew correction, therefore, the predetermined threshold angle of inclination of thick paper may be smaller than that of thin paper. An optimum predetermined threshold angle of inclination of a sheet varies depending on the thickness of the sheet.

As for the ratio, the predetermined value may be changed depending on the thickness of the sheet to be subjected to printing. In some embodiments, a predetermined value for thick paper may be smaller than a predetermined value for thin paper. Thus, a sheet can be properly bent by registration roller pair 55 to correct skew of the sheet.

Conveying control after the start of sheet conveyance from registration roller pair 55 (START) will be described below with reference to FIG. 9. Since steps 232 to 234 are the same as steps 211 to 213 described above, explanation thereof is omitted. In various embodiments, control unit 1 acquires a second reference value for ratio calculation. The second reference value is a reception level of receiving unit 92 (a voltage of reception level signal LV2) determined when the sheet P reaches fixing unit 7 (when the inclination of the sheet P relative to the conveying direction is 0 degree) (step 235).

Control unit 1 determines whether or not there is bending upstream from fixing unit 7 in conveying path 5 (step 236). Specifically, control unit 1 determines whether the ratio calculated by dividing a reception level of receiving unit 92 (a voltage of the reception level signal LV2) by the second reference value is greater than 1. Specifically, control unit 1 calculates the ratio of a reception level of receiving unit 92 determined after the sheet P reaches fixing unit 7 to the second reference value and determines, on the basis of the ratio, whether bending has occurred. An output voltage of receiving unit 92 increases as the angle of inclination of the sheet P increases. When the ratio is greater than 1, therefore, control unit 1 can determine the occurrence of bending. Since steps 237 and 238 are the same as steps 215 and 216 in the first embodiment, explanation thereof is omitted.

With the above-described structure as described in reference to FIGS. 8-9, a reception level of receiving unit 82 (the first receiving unit) tends to increase with increasing the angle of inclination of a sheet P relative to the sheet conveying direction, irrespective of the thickness of the sheet P. The angle of inclination of the sheet P can be obtained by calculating the ratio of the reception level of receiving unit 82 detected when the extent of bending of the sheet P is increased by continuous conveyance of the sheet P to the reception level of receiving unit 82 detected when the sheet P reaches registration roller pair 55, irrespective of the thickness of the sheet. Thus, the sheet P can be properly bent to correct for skew.

In addition, the ratio of a reception level of receiving unit 92 detected when the extent of bending of the sheet P is increased by continuously conveying the sheet P to a reception level of receiving unit 92 as the reference reception level of receiving unit 92 (the second receiving unit) detected when the sheet P reaches the fixing unit 7 is calculated. Thus, as the ratio is larger, the extent of bending of the sheet P is also larger, irrespective of the thickness. Accordingly, bending of a sheet upstream from fixing unit 7 can be properly removed, irrespective of the thickness of the sheet P.

Having thus described in detail embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. An image forming apparatus comprising:

a paper feeding unit operable for feeding a sheet;

an image forming unit operable for forming a toner image on the sheet;

a skew correcting roller pair which the conveyed sheet contacts such that at least a portion of the sheet bends;

a rotary member pair operable for conveying the sheet to the skew correcting roller pair;

a first sensor disposed upstream of the skew correcting roller pair in the sheet conveying direction in which the sheet is conveyed, the first sensor comprising:

a first transmitting unit operable for transmitting a sending signal; and a first receiving unit positioned opposite the first transmitting unit having an interval therebetween such that a conveying path through which the sheet is conveyed is disposed therebetween and which is configured to output an output voltage representative of the sending signal received by the first receiving unit;

a first signal processing unit configured to process the output voltage of the first receiving unit and configured to output a first reception level signal indicating a reception level of the sending signal received by the first receiving unit from the sending signal transmitted by the first transmitting unit; and a control unit configured to:

control sheet conveyance in the image forming apparatus;

receive the first reception level signal; and evaluate, based on at least the first reception level signal, bending of the sheet contacting the skew correcting roller pair;

wherein the skew correcting roller pair is rotated after the sheet is sufficiently bent.

2. The image forming apparatus according to claim 1, wherein the first sensor comprises an ultrasonic sensor.

3. The image forming apparatus according to claim 1, wherein the skew correcting roller pair includes registration rollers disposed upstream of the image forming unit in the sheet conveying direction.

4. The image forming apparatus according to claim 1, wherein the control unit evaluates bending of the sheet according to a predetermined relationship between the angle of inclination of the sheet and the first reception level signal.

5. The image forming apparatus according to claim 1, wherein the control unit allows the rotary member to continuously convey the sheet until the first reception level signal reaches a predetermined reception level.

6. The image forming apparatus according to claim 5, further comprising:

an input unit accepting an input to specify the thickness of the sheet to be subjected to printing, wherein the control unit sets the predetermined reception level such that a predetermined reception level set when the specified thickness is thick is lower than a predetermined reception level set when the specified thickness is thin.

7. The image forming apparatus according to claim 1, wherein the control unit calculates a ratio of the reception level of the first receiving unit detected during continuously rotating the rotary member to a reference reception level thereof detected when the sheet reaches the skew correcting roller pair and allows the rotary member to continuously convey the sheet until the ratio reaches a predetermined value.

8. The image forming apparatus according to claim 7, further comprising:

an input unit accepting an input to specify the thickness of a sheet to be subjected to printing, wherein the control unit sets the predetermined value to one of a plurality of values that depends on the specified thickness.

9. The image forming apparatus according to claim 1, further comprising:

a fixing unit disposed downstream of the image forming unit in the sheet conveying direction, the fixing unit operable for fixing a toner image onto the sheet;

a second sensor disposed upstream of the fixing unit in the sheet conveying direction in which the sheet is conveyed, the second sensor comprising:

a second transmitting unit transmitting a sending signal; and a second receiving unit positioned opposite the second transmitting unit having an interval therebetween such that the conveying path through which the sheet is conveyed is disposed therebetween and wherein the second receiving unit is configured to output an output voltage representative of the sending signal received by the second receiving unit;

and a second signal processing unit configured to:

process the output voltage of the second receiving unit; and output a second reception level signal indicating a reception level of the sending signal received by the second receiving unit from the sending signal transmitted by the second transmitting unit, wherein the control unit receives the second reception level signal, evaluates, based on at least the second reception level signal, bending of the sheet entering the fixing unit, and when the occurrence of bending is detected, allows the fixing unit to raise a sheet conveying speed.

10. The image forming apparatus according to claim 9, wherein the control unit calculates a ratio of the reception level of the second receiving unit detected after the sheet reaches the fixing unit to a reference reception level thereof detected when the sheet reaches the fixing unit and determines on the basis of the ratio whether bending has occurred.

11. The image forming apparatus according to claim 1, wherein the control unit determines whether the sheet is sufficiently bent according to whether a value representing the reception level of the first receiving unit reaches a predetermined level.

12. The image forming apparatus according to claim 11, wherein the value representing the reception level of the first receiving unit is substantially equal to the reception level of the first receiving unit.

13. The image forming apparatus according to claim 11, wherein the value representing the reception level of the first receiving unit is substantially equal to a ratio between values of the reception level of the first receiving unit detected by the first receiving unit at different times.

14. The image forming apparatus according to claim 1, wherein the first signal processing unit and the control unit are integrated as a single component.

15. The image forming apparatus according to claim 1, wherein the control unit further determines, based on the first reception level signal, whether multiple sheets feeding has occurred.

16. An image forming apparatus comprising:

a paper feeding unit configured for feeding a sheet;

an image forming unit configured for forming a toner image on the sheet;

a skew correcting roller pair which the conveyed sheet contacts such that at least a portion of the sheet bends and which is rotated after the sheet is sufficiently bent;

a rotary member pair configured for conveying the sheet to the skew correcting roller pair;

a first sensor disposed upstream of the skew correcting roller pair in the sheet conveying direction in which the sheet is conveyed, the first sensor comprising:

a first transmitting unit operable for transmitting a sending signal; and a first receiving unit positioned opposite the first transmitting unit having an interval therebetween such that a conveying path through which the conveyed sheet is conveyed therebetween and which is configured to output an output voltage representative of the sending signal received by the first receiving unit;

a first signal processing unit configured to process the output voltage of the first receiving unit to output a first reception level signal indicating a reception level of the sending signal received by the first receiving unit from the sending signal transmitted by the first transmitting unit; and a control unit configured for at least (i) controlling sheet conveyance in the image forming apparatus, (ii) receiving the first reception level signal, and (iii) determining, based on at least the first reception level signal, whether multiple sheets feeding has occurred and whether the sheet contacting the skew correcting roller pair is sufficiently bent.

17. An image forming apparatus according to claim 16, further comprising:

a fixing unit disposed downstream of the image forming unit in the sheet conveying direction, the fixing unit configured for fixing a toner image onto the sheet;

a second sensor disposed upstream of the fixing unit in the sheet conveying direction, the sensor including a second transmitting unit operable for transmitting a sending signal and a second receiving unit which is opposed to the second transmitting unit having an interval therebetween such that a conveying path through which the sheet is conveyed is disposed therebetween and which is operable to output an output voltage representative of the sending signal received by the second receiving unit;

and a second signal processing unit operable for processing the output voltage of the second receiving unit to output a second reception level signal indicating a reception level of the sending signal received by the second receiving unit from the sending signal transmitted by the first transmitting unit, wherein the control unit is configured to (i) receive the second reception level signal, (ii) detect on the basis of the second reception level signal whether bending of the sheet entering the fixing unit has occurred, and (iii) when the occurrence of bending is detected, allow the fixing unit to raise a sheet conveying speed.

* * * * *